United States Patent [19]

Morse

[11] Patent Number: 4,864,899

[45] Date of Patent: Sep. 12, 1989

[54] ILLUMINATING LIGHT BULB REMOVER

[76] Inventor: John D. Morse, 3920 Ferris Ave., Fremont, Mich. 49412

[21] Appl. No.: 696,864

[22] Filed: Jan. 30, 1985

Related U.S. Application Data

[63] Continuation of Ser. No. 520,988, Aug. 8, 1983, abandoned.

[51] Int. Cl.[4] ..... H01K 3/32

[52] U.S. Cl. ..... 81/53.11; 294/99.1

[58] Field of Search ..... 294/20, 19 A, 19 R, 294/21, 81 R, 99 R, 100, 1 R; 81/3, 43, 64, 185; 221/310; 362/109, 119, 120

[56] References Cited

U.S. PATENT DOCUMENTS 1,223,921 4/1917 Zeisel ..... 294/20

1,541,839 6/1925 Metzler et al. ..... 294/20

2,157,563 5/1939 Pethick ..... 294/20

*Primary Examiner*—James B. Marbert

*Attorney, Agent, or Firm*—Gifford, Groh, Sheridan, Sprinkle and Dolgorukov

[57] ABSTRACT

A hand held light bulb removing device with means for illuminating the working area. The device includes an elongated handle, a frusto-conical member detachably secured to the handle, illuminating means embedded in the handle, and switching means to engage the illuminating means. The frusto-conical member accepts the light bulb of an overhead light fixture and provides the resistance necessary to rotate the light bulb. The illuminating means located in the end of the handle provides the illumination necessary to locate the light fixture in a darkened room.

9 Claims, 1 Drawing Sheet

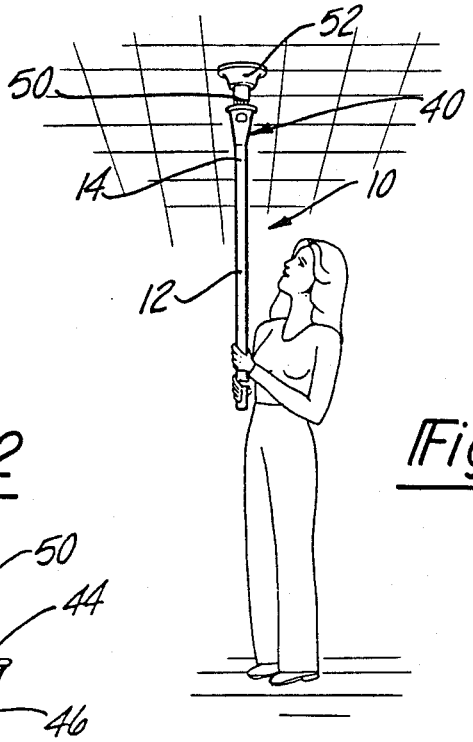
Fig-1
Fig-2
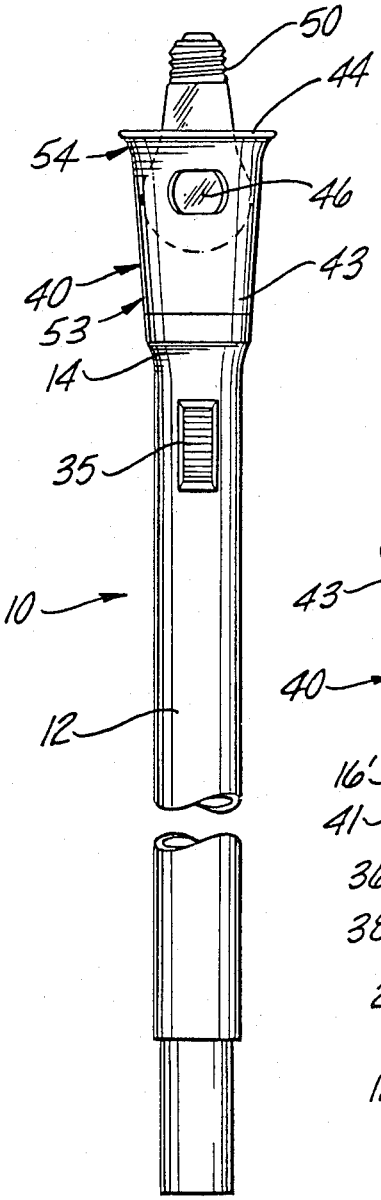
Fig-4
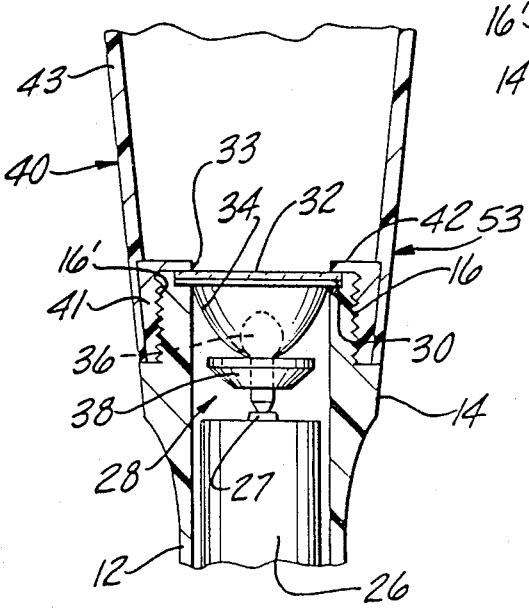
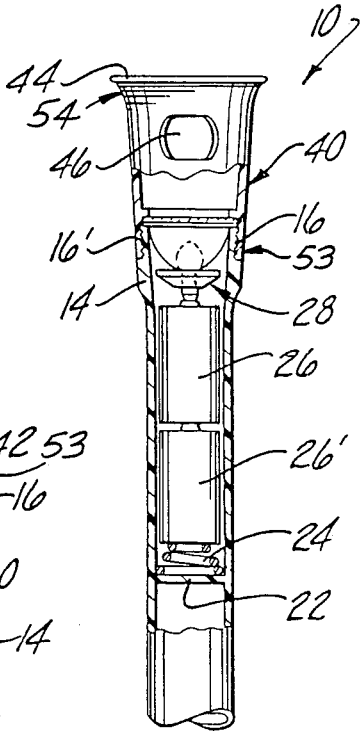
Fig-3

ILLUMINATING LIGHT BULB REMOVER

This application is a continuation of application Ser. No. 520,988 filed Aug. 8, 1983.

BACKGROUND OF THE INVENTION

I. Field of the Invention

This invention relates to light bulb removing devices and in particular, to a light bulb removing device which provides illumination of the light fixture and easy access to out-of-reach overhead fixtures.

II. Description of the Prior Art

Light bulb removers which provide access to out-of-reach light fixtures have been proposed for use utilizing a variety of means to grasp the bulb. One common method utilizes several finger-like extensions to grisp the light bulb. These extensions are generally made of metal and are opened and closed by way of a trigger mechanism in the handle of the device. Rubber pads may be provided on the tips of the extensions to facilitate gripping of the light bulb. Such devices have not found widespread use because of the cumbersome mechanisms employed which have a tendency to malfunction. Furthermore, such mechanisms substantially increase the cost of such devices.

An alternative light bulb removing device utilizes a plurality of spring extensions to grip the electric light bulb. The extensions are generally made of metal and encompass the bulb when pressure is applied forcing the finger-like extensions open. Other devices have employed rubber coated extensions to provide a better grip of the light bulb.

In general, the prior art devices have been found to be cumbersome and unreliable because of the mechanisms involved in these devices. Moreover, these devices can prove quite troublesome in accomplishing the main objection of the device-changing a burnt out light bulb. Although there may be times when alternative light is available, many times the burnt out bulb is the only source of light and therefore simply finding the light fixture using the prior art devices can be difficult. The present invention overcomes the shortcomings of the earlier devices by providing a light weight device which is capable of illuminating the light fixture thereby allowing a burnt out bulb to be changed in even the darkest areas.

SUMMARY OF THE PRESENT INVENTION

The present invention is an improved light bulb removing device which overcomes the disadvantages of the previously known light bulb removing devices.

The light bulb removing device according to the present invention comprises an elongated handle detachably secured to a frusto-conical member. The frusto-conical member is preferably made of a resilient material to provide flexibility. Around the circumference of the member is a series of openings which allows the light bulb to be grasped and frictionally rotated. Embedded within the handle at the point where the handle is secured to the frusto-conical member is the illuminating device. The illumination is provided by a low-power light bulb of the type generally found in flashlights, and a concave reflector which enhances the illumination. The bulb is powered by a pair of flashlight batteries encased in the handle of the device. The bulb is turned on and off using a switch located on the outside of the hindle.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of the preferred embodiment of the present invention when read in conjunction with the accompanying drawing, in which like reference characters refer to like parts throughout the views, and in which:

FIG. 1 is a perspective view of the preferred embodiment of the present invention in use;

FIG. 2 is an elevated view of the light bulb removing device;

FIG. 3 is a partial cross-sectional view of the device of FIG. 2; and

FIG. 4 is an enlarged cross-sectional view of the device of FIG. 2.

DETAILED DESCRIPTION OF THE PREFERRED EMBODIMENT

Referring to FIGS. 1 through 4, there is shown a light bulb removing device 10 embodying the present invention and comprising an elongated handle 12 and a frusto-conical member 40. The elongated handle 12 is preferably tubular and comprises first end 14 and a battery compartment 20. Alternatively, a telescopic handle, as shown in FIG. 2, may be substituted to provide adjustment in order to reach a variety of heights and to provide easy storage of the device. In either case, the handle is preferably constructed of a strong plastic so that the device remains lightweight. Referring particularly to FIGS. 3 and 4, first end 14 of handle 12 is provided with threads 16 whereby frusto-conical member 40 can be detachably secured to handle 12. The threads 16 made with threads 16' of frusto-conical member 40.

The battery compartment 20 is also tubular and comprises supporting wall 22 and tension spring 24 which support the two standard "D" size flashlight batteries 26 and 26'. The illuminating means 28, as shown in FIG. 4, is supported by annular shoulder 30 located at first end 14 of handle 12. The illuminating means 28 preferably comprises protective lens 32, concave reflector 34, and incandescent flashlight bulb 36 with bulb support member 38.

The frusto-conical member 40 is made of a resilient plastic and comprises sleeve 43 and annular member 41. A narrow end 53 of sleeve 43 frictionally engages member 41 and can be removed in order that the device 10 can be used as an elongated illumination device or flashlight. The member 41 comprises threads 16' and annular flange 42. As frusto-conical member 40 is secured to first end 14 of handle 12, the annular flange 42 guides and secures rim 33 of illuminating means 28 into annular shoulder 30. The pressure upon illuminating means 28 caused by annular flange 42 translates upon the batteries 26 and 26' thereby causing the tension spring 24 to compress. The pressure exerted between the spring 24 and the flange 42 provides the necessary contact between the illuminating means 28 and terminal 27 of the battery 26.

Sleeve 43 of frusto-conical member 40 comprises a wide end 54 having an annular, radially outwardly flared rim 44 and a plurality of openings 46. As shown in FIG. 2, portions of the outer circumference of light bulb 50 protrude through the openings 46 thereby providing the resistance necessary to allow rotation of the light bulb 50 relative to the light fixture 52 (FIG. 1).

The device 10 further comprises switch 35 located on the circumference of handle 12 which connects/disconnects the power provided by the batteries 26 and 26' to the illuminating means 28. Thus by placing the switch 35 in the on or connect position the illuminating means 28 is activated thereby providing illumination of the light bulb 50 and light fixture 52.

Thus, the light bulb removing device provides not only simplified removal of light bulbs from overhead fixtures but also illumination of the light fixture in a darkened room.

The foregoing detailed description has been given for clearness of understanding only and no unnecessary limitations should be understood therefrom as some modifications will be obvious to those skilled in the art.

What is claimed is:

1. A light bulb changing device comprising:

an elongated handle having an end;

illuminating means supported within said handle end;

a frustoconical sleeve having a narrow end disposed adjacent said handle end, a wide sleeve end opposite said narrow sleeve end, and a radially outwardly flared rim on said wide sleeve end; and means for detachably securing said narrow sleeve end to said handle end, comprising an annular member disposed between and detachably secured to each of said handle end and said narrow sleeve end.

2. The invention according to claim 1, wherein said handle end and said annular member comprise matching threads formed thereon.

3. The invention according to claim 1, wherein said narrow sleeve end is slidably engaged with said annular member.

4. The invention according to claim 1, wherein said illuminating means comprises a reflector in said handle end, an incandescent bulb disposed outwardly of said reflector, and means for supplying electricity to said bulb.

5. The invention according to claim 4, wherein said supply means comprises means for supporting at least one battery within said handle end.

6. The invention according to claim 1, wherein said sleeve comprises a resilient plastic material.

7. The invention according to claim 6, wherein said sleeve comprises a plurality of openings whose edges are adapted to engage the surface of a light bulb to be changed.

8. The invention according to claim 2, wherein said narrow sleeve end is slidably engaged with said annular member.

9. The invention according to claim 1, wherein said narrow sleeve end is disposed about said handle end.

* * * * *